US012458840B2

(12) United States Patent
Hamoy

(10) Patent No.: US 12,458,840 B2
(45) Date of Patent: Nov. 4, 2025

(54) EXERCISE DEVICE

(71) Applicant: Dustin Hamoy, Waverly, MD (US)

(72) Inventor: Dustin Hamoy, Waverly, MD (US)

( * ) Notice: Subject to any disclaimer, the term of this patent is extended or adjusted under 35 U.S.C. 154(b) by 185 days.

(21) Appl. No.: 18/367,210

(22) Filed: Sep. 12, 2023

(65) Prior Publication Data

US 2025/0082991 A1 Mar. 13, 2025

(51) Int. Cl.

| | |
|---|---|
| ***A63B 23/02*** | (2006.01) |
| ***A63B 21/00*** | (2006.01) |
| ***A63B 22/20*** | (2006.01) |
| ***A63B 71/00*** | (2006.01) |

(52) U.S. Cl.

CPC ..... *A63B 23/0216* (2013.01); *A63B 21/4035* (2015.10); *A63B 22/20* (2013.01); *A63B 71/0036* (2013.01); *A63B 2225/093* (2013.01)

(58) Field of Classification Search

CPC . A63B 22/20; A63B 23/0205; A63B 23/0211; A63B 23/0216; A63B 23/0222; A63B 23/0227

See application file for complete search history.

(56) References Cited

U.S. PATENT DOCUMENTS

| | | | | |
|---|---|---|---|---|
| 5,518,483 | A * | 5/1996 | Oswald | A63B 21/012 482/130 |
| 6,607,472 | B2 | 8/2003 | Toole | |
| 7,662,076 | B1 * | 2/2010 | Ho | A63B 21/068 482/130 |
| 7,878,954 | B2 | 2/2011 | McBride | |
| 7,963,895 | B2 | 6/2011 | Noheil | |
| 8,079,941 | B2 | 12/2011 | Nortje | |
| 8,708,873 | B2 | 4/2014 | Birch | |
| 8,888,661 | B2 * | 11/2014 | Ellis | A63B 22/205 482/96 |
| 9,655,455 | B2 * | 5/2017 | Barnett | A47C 9/002 |
| 9,687,693 | B2 * | 6/2017 | Archer | A63B 69/0062 |
| 9,737,751 | B2 | 8/2017 | Anderson | |
| 2003/0036467 | A1 * | 2/2003 | Almada | A63B 41/125 482/148 |
| 2004/0077468 | A1 * | 4/2004 | Myles, Sr. | A63B 23/0222 482/140 |
| 2009/0305853 | A1 * | 12/2009 | Jordan | A63B 22/20 434/258 |
| 2010/0267526 | A1 * | 10/2010 | Baschnagel | A63B 21/4043 482/148 |
| 2017/0087398 | A1 * | 3/2017 | Chang | A63B 21/0557 |
| 2017/0296864 | A1 * | 10/2017 | Richter | A63B 21/072 |
| 2020/0276472 | A1 * | 9/2020 | Hamoy | A63B 69/0059 |

* cited by examiner

*Primary Examiner* — Joshua T Kennedy

(57) ABSTRACT

An exercise device for exercising generally with particular attention to the core muscles of the torso and abdomen includes a base. An upper surface of the base is hemispherical to require a person kneeling on the base to flex core muscles to maintain balance on the base. Each of a plurality of wheels is coupled to a bottom of the base. A stand includes a pedestal having a receiver complementary to the base. An upper body platform includes a pair of arm rests and a pair of grips. A support extends between the upper body platform and the pedestal. A locking mechanism secures the base to the pedestal such that the base is in a static position relative to the stand when the locking mechanism is engaged.

18 Claims, 7 Drawing Sheets

EXERCISE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to exercise device and more particularly pertains to a new exercise device for exercising generally with particular attention to the core muscles of the torso and abdomen.

(2) Description of Related Art Including Information Disclosed Under 37 CFR 1.97 and 1.98

The prior art relates to exercise devices but they lack upper body support while core muscles are used to move the lower body freely on a support surface.

BRIEF SUMMARY OF THE INVENTION

An embodiment of the disclosure meets the needs presented above by generally comprising a base. An upper surface of the base is hemispherical to require a person kneeling on the base to flex core muscles to maintain balance on the base. Each of a plurality of wheels is coupled to a bottom of the base. A stand includes a pedestal having a receiver complementary to the base. An upper body platform includes a pair of arm rests and a pair of grips. A support extends between the upper body platform and the pedestal. A locking mechanism secures the base to the pedestal such that the base is in a static position relative to the stand when the locking mechanism is engaged.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
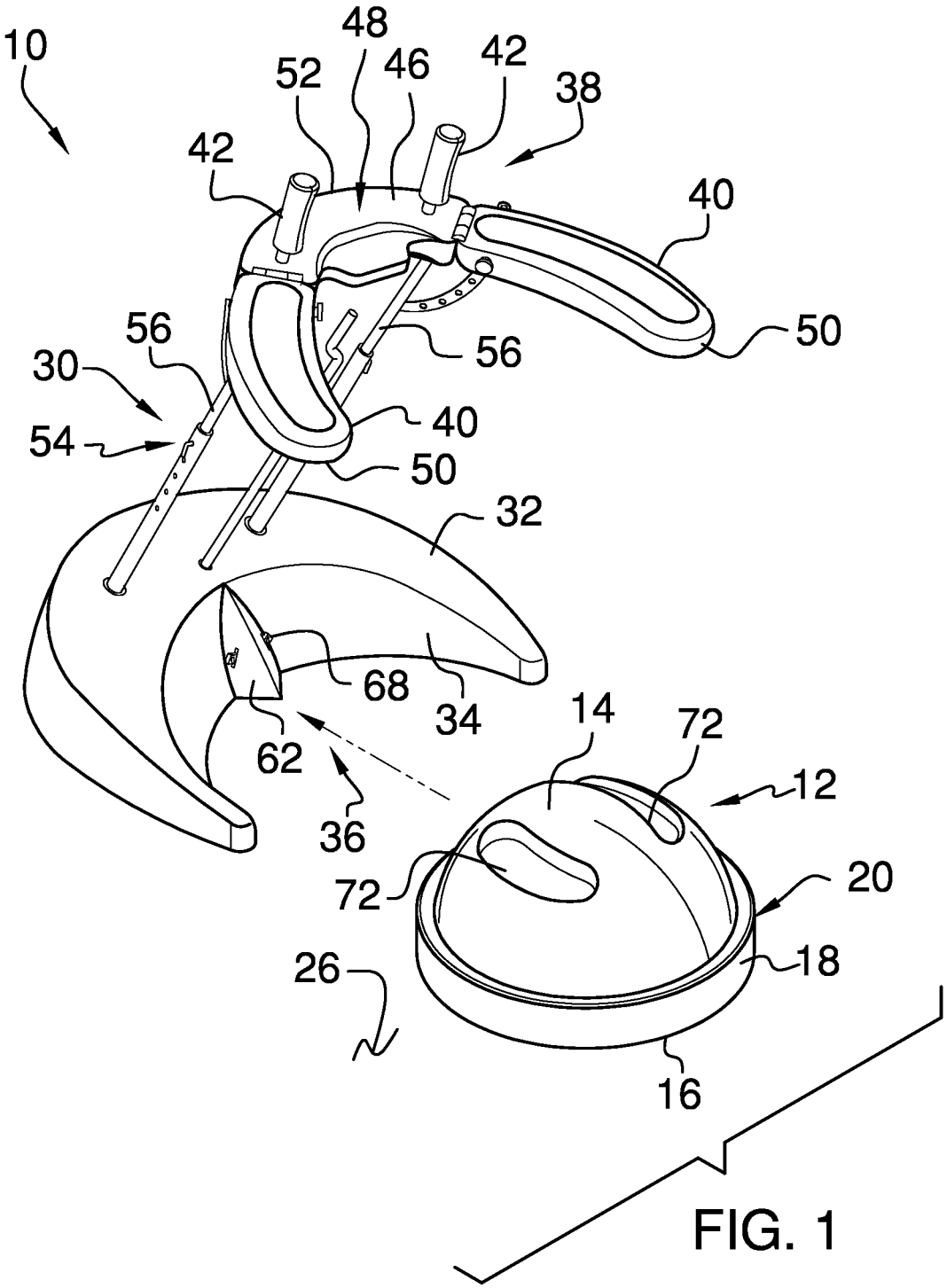
FIG. 1 is a top front side perspective view of an exercise device according to an embodiment of the disclosure.
Figure 2:
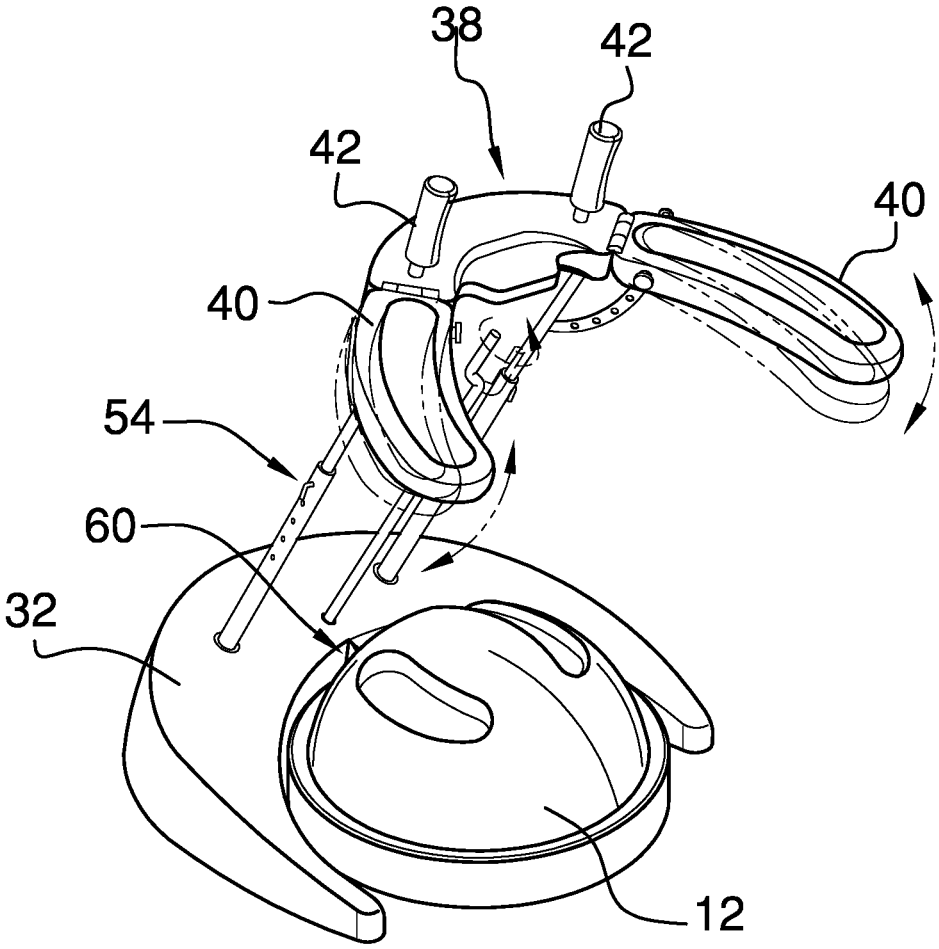
FIG. 2 is a top front side perspective view of an embodiment of the disclosure.
Figure 3:
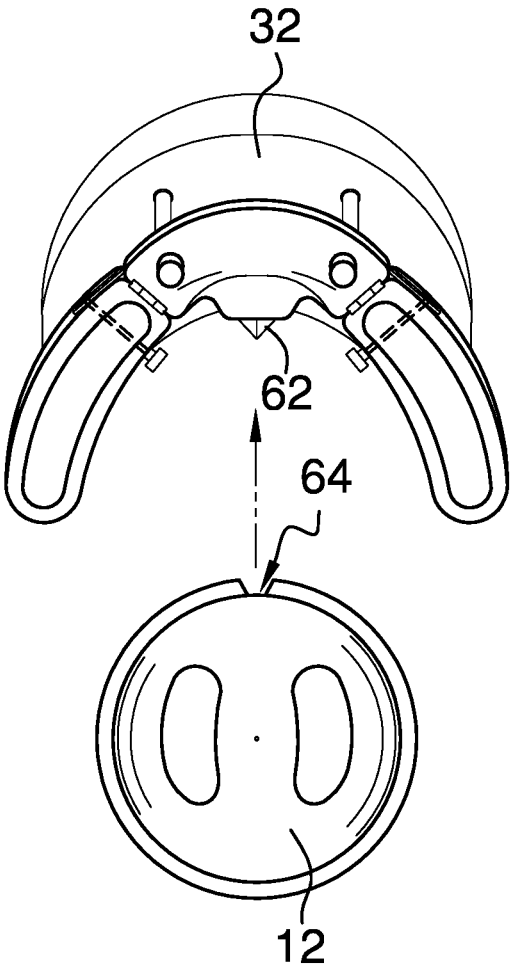
FIG. 3 is a top view of an embodiment of the disclosure.
Figure 4:
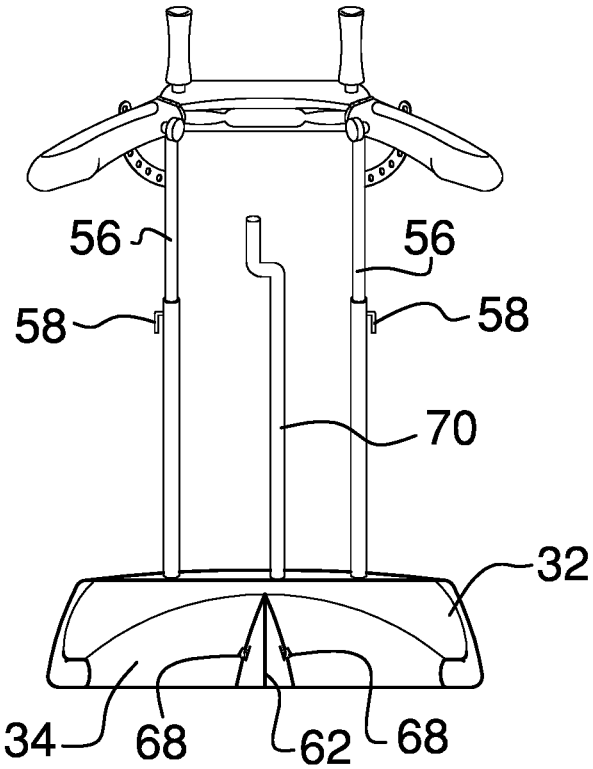
FIG. 4 is a front view of a stand of an embodiment of the disclosure.
Figure 5:
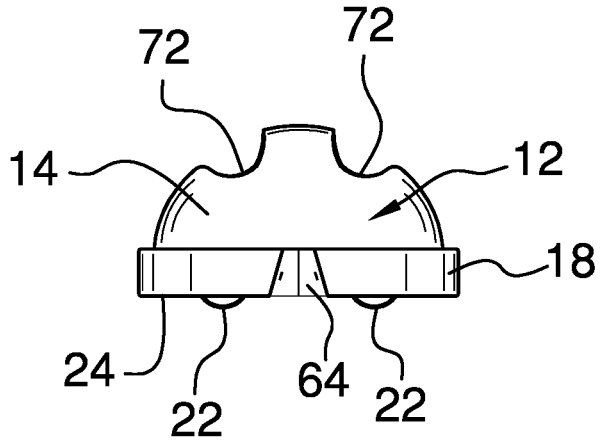
FIG. 5 is a front view of a base of an embodiment of the disclosure.
Figure 6:
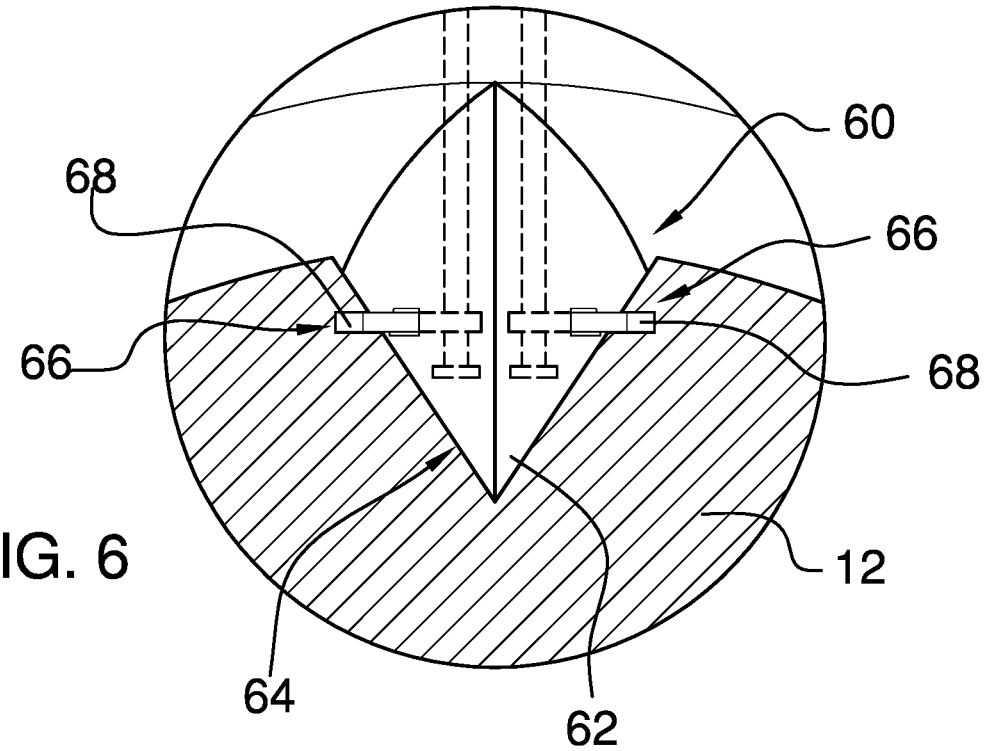
FIG. 6 is a partial cutaway top detailed view of an embodiment of the disclosure.
Figure 7:
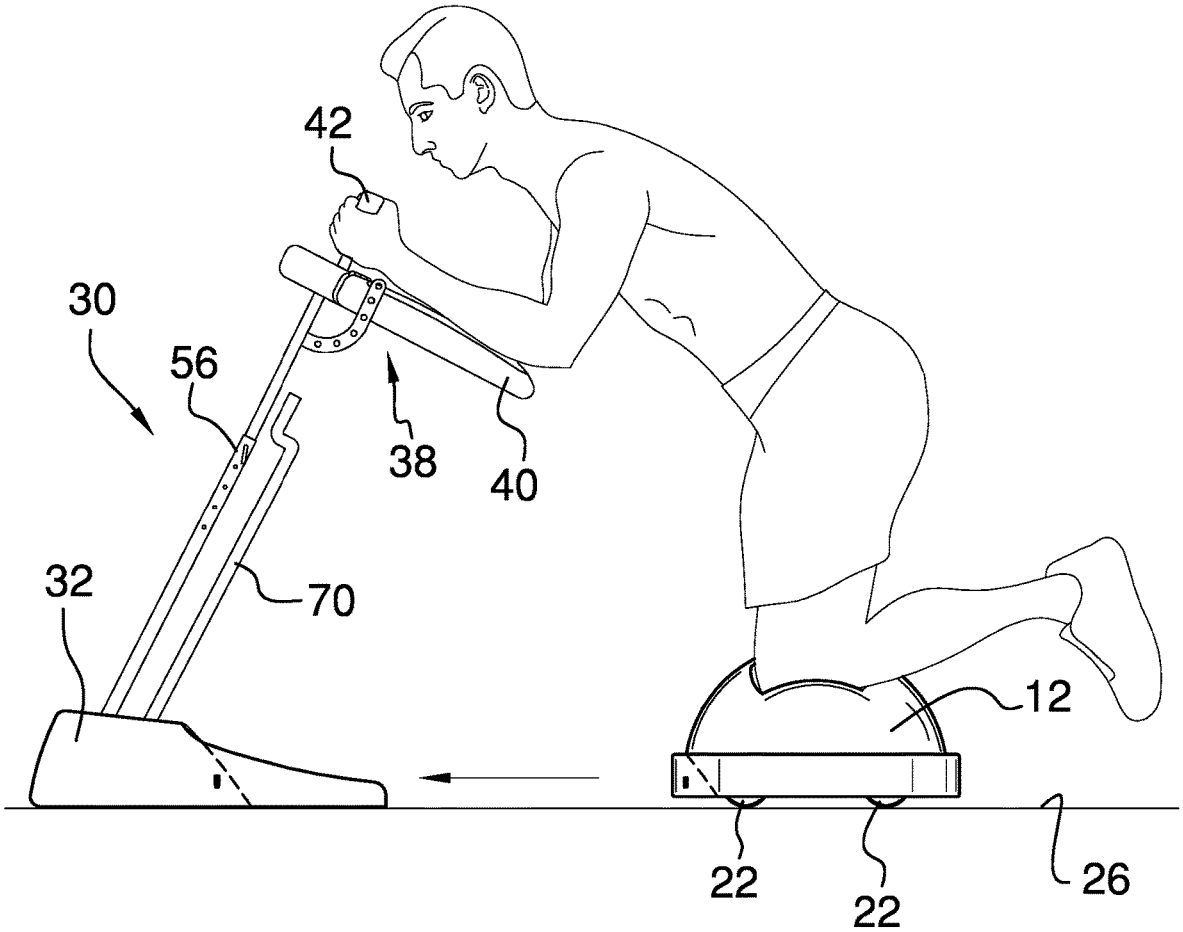
FIG. 7 is a side view of an embodiment of the disclosure in use.
Figure 8:
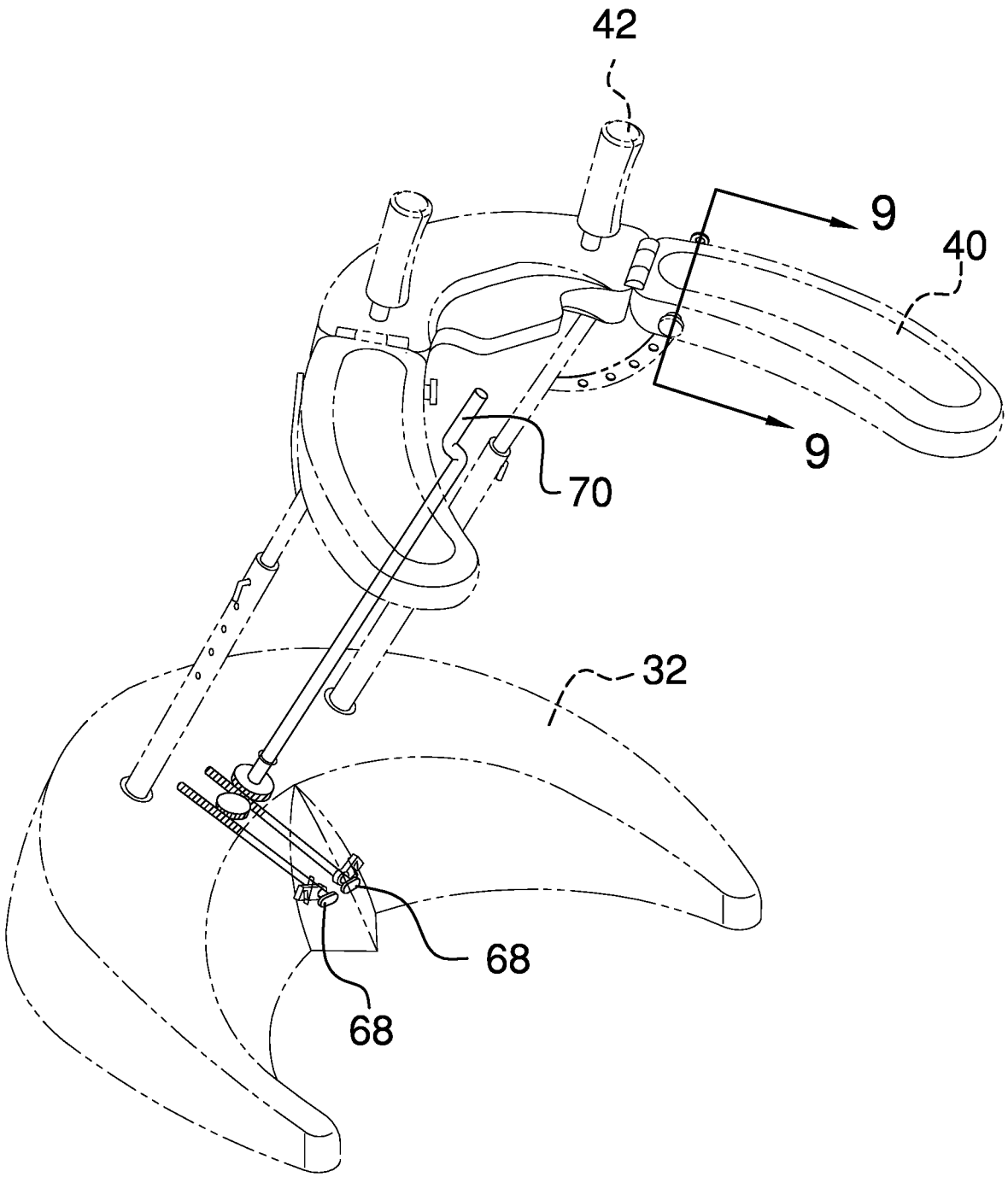
FIG. 8 is a top front side perspective partial phantom view of an embodiment of the disclosure.
Figure 9:
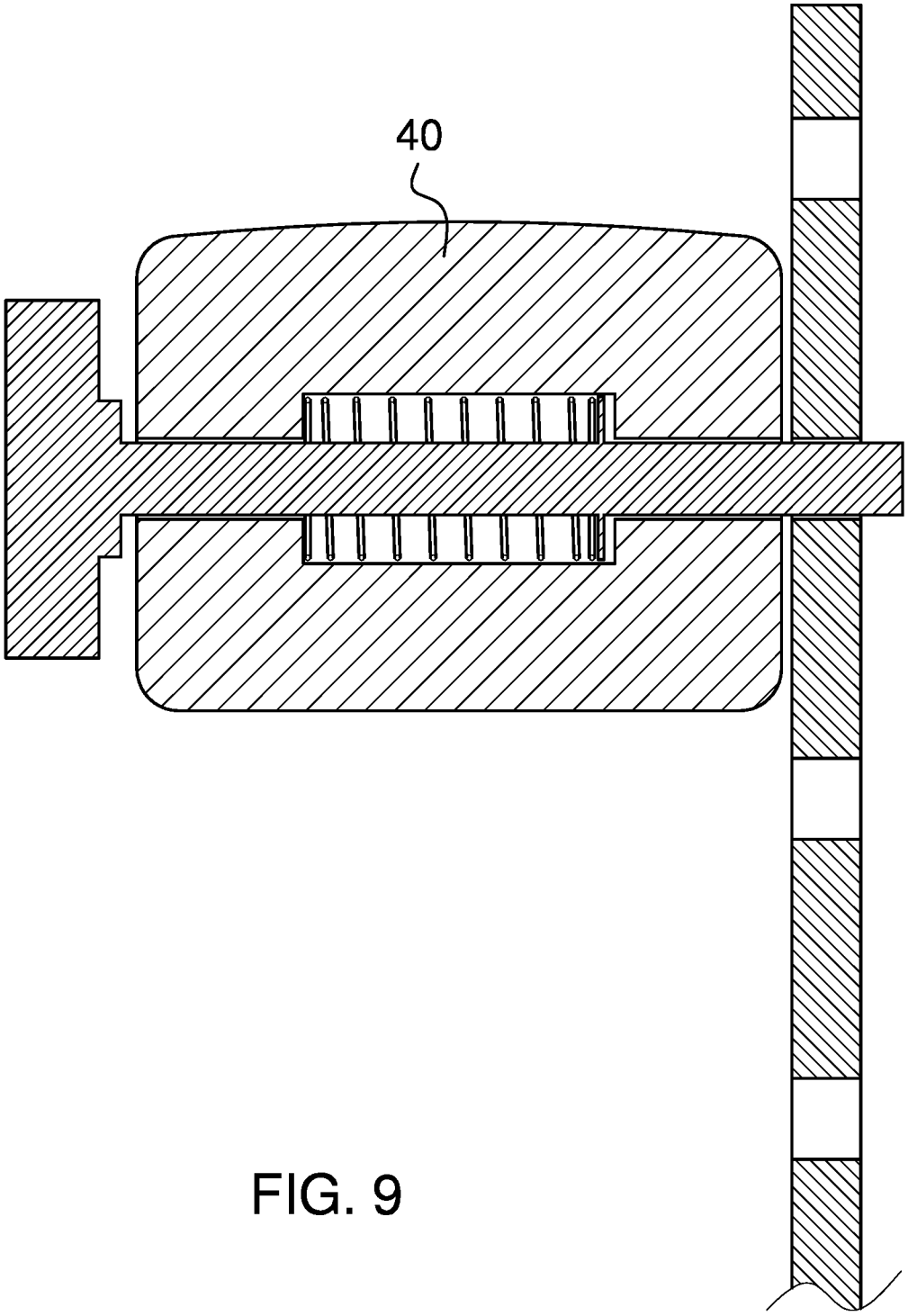
FIG. 9 is a cross-sectional view of an embodiment of the disclosure taken along line 9-9 of FIG. 8.

With reference now to the drawings, and in particular to FIGS. 1 through 9 thereof, a new exercise device embodying the principles and concepts of an embodiment of the disclosure and generally designated by the reference numeral 10 will be described.

As best illustrated in FIGS. 1 through 9, the exercise device 10 generally comprises a base 12 having an upper surface 14. The upper surface 14 is hemispherical wherein the base 12 is configured to require a person kneeling on the base 12 to flex core muscles to maintain balance on the base 12. The upper surface 14 of the base 12 is resiliently compressible such that the upper surface 14 will support the person and maintain contact with the person kneeling on the base 12 even when the person lifts slightly away from the base 12. A peripheral edge 16 of the base 12 may be circular. A lip 18 extends around a lower portion 20 of the upper surface 14. The lip 18 defines the peripheral edge 16 of the base 12. Each of a plurality of wheels 22 is coupled to and extends from a bottom 24 of the base 12. Thus, the base 12 is configured to roll on a support surface 26. The wheels 22 could be directional to provide for specific movement of the base 12 back and forth. Alternatively for more advanced exercise, the wheels 22 may be caster wheels to rotate relative to the base 12. Thus, the base 12 can move in any direction requiring the person to use their core muscles to control movement of the base including laterally on the support surface, twisting on the support surface, or a combination of movements.

A stand 30 includes a pedestal 32. The pedestal 32 has a concave edge 34 defining a receiver 36 complementary to the base 12 wherein the base 12 is positionable abutting the pedestal 32 within the receiver 36. The stand 30 includes an upper body platform 38 having a pair of arm rests 40 and a pair of grips 42. Each of the grips 42 extends perpendicularly to a top surface 46 of the upper body platform 38. Each of the grips 42 is positioned adjacent to a respective one of the arm rests 40. Each of the arm rests 40 is pivotally coupled to a central section 48 of the upper body platform 38. Each of the arm rests 40 is pivotable such that a distal end 50 of the arm rest 40 relative to the central section 48 is movable vertically. Each of the arm rests 40 may also be pivotable such that the distal end 50 of the arm rest 40 is adjustable forwardly and rearwardly relative to the central section 48. The upper body platform 38 is angled such that the upper body platform 38 extends downward and rearwardly from a forward edge 52 of the upper body platform 38. A support 54 is coupled to and extends between the upper body platform 38 and the pedestal 32. The support 54 is telescopic wherein a distance between the upper body platform 38 and the pedestal 32 is adjustable. The support 54 may include a pair of telescopic posts 56 utilizing alignable apertures and a pin 58 or other conventional mechanism for adjusting and securing the support 54 at a selected length.

A locking mechanism 60 secures the base 12 to the pedestal 32 such that the base 12 is in a static position relative to the stand 30 when the locking mechanism 60 is engaged. A tongue 62 coupled to the pedestal 32. The tongue 62 extends from the concave edge 34 wherein the tongue 62 protrudes into the receiver 36. A groove 64 extends into the peripheral edge 16 of the base 12. The groove 64 is complementary in shape to the tongue 62. The locking mechanism 60 extends between the tongue 62 and the groove 64 for securing the pedestal 32 and the base 12 together when the locking mechanism 60 is engaged. The locking mechanism 60 includes a pair of recesses 66 extending into the base 12. The recesses 66 are positioned in and extend into the base 12 from within the groove 64. Each of a pair of locking tabs 68 is extendable from the tongue 62. Each of the locking tabs 68 extends into a respective one of the recesses 66 whereby the locking tabs 68 inhibit movement of the base 12 away from the pedestal 32. A lever 70 is mechanically coupled to each of the locking tabs 68 such that movement of the lever 70 extends and retracts the locking tabs 68. The lever 70 of the locking mechanism 60 is positioned on the pedestal 32. The lever 70 is aligned with the tongue 62 and positioned vertically spaced above the tongue 62 allowing the person to discern the position of the tongue 62 without having to look fully down to the pedestal 32.

Each of a pair of channels 72 may be positioned in the upper surface 14 of the base 12. Each of the channels 72 may be kidney shaped. The channels 72 are symmetrical about a diameter of the base 12 extending through a center of the groove 64.

In use, the person positions their legs on the upper surface 14 of the base 12. The arm rests 40 may be positioned as desired for comfort and providing more or less direct support of the arms of the person. While grasping one of the grips 42, the lever 70 may be manipulated to release the base 12 from the pedestal 32. The person may then use core muscles of the torso and abdomen, and any other muscles required, to maintain balance on the base 12 while moving the base 12 through a desired or set pattern of movements relative to the position of the pedestal 32. Upon completion of exercise, the person moves to position the base 12 within the receiver 36. The lever 70 may be manipulated to lock the base 12 in a static position within the receiver 36. The lever 70 may also, or alternatively, be mechanically biased such that the locking tabs 68 engage the recesses 66 upon the tongue 62 being firmly positioned within the groove 64.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An exercise device comprising:

a base, said base having an upper surface, said upper surface being hemispherical wherein said base is configured to require a person kneeling on said base to flex core muscles to maintain balance on said base;

a plurality of wheels coupled to and extending from a bottom of said base wherein said base is configured to roll on a support surface;

a stand, said stand including a pedestal, said pedestal having concave edge defining a receiver complementary to said base wherein said base is positionable abutting said pedestal within said receiver, an upper body platform including a pair of arm rests and a pair of grips, and a support coupled to and extending between said upper body platform and said pedestal;

a locking mechanism, said locking mechanism securing said base to said pedestal such that said base is in a static position relative to said stand when said locking mechanism is engaged;

a tongue coupled to said pedestal, said tongue extending from said concave edge wherein said tongue protrudes into said receiver; and a groove extending into a peripheral edge of said base, said groove being complementary in shape to said tongue.

2. The exercise device of claim 1, further comprising said locking mechanism extending between said tongue and said groove for securing said pedestal and said base together when said locking mechanism is engaged.

3. The exercise device of claim 1, further comprising said support being telescopic wherein a distance between said upper body platform and said pedestal is adjustable.

4. The exercise device of claim 1, further comprising said support comprising a pair of telescopic posts.

5. The exercise device of claim 1, further comprising:

said locking mechanism including a pair of recesses extending into said base, said recesses being positioned in and extending into said base from within said groove, and said locking mechanism including a pair of locking tabs, each of said locking tabs being extendable from said tongue, each of said locking tabs extending into a respective one of said recesses whereby said locking tabs inhibit movement of said base away from said pedestal.

6. The exercise device of claim 5, further comprising said locking mechanism including a lever, each of said locking tabs being mechanically coupled to said lever such that movement of said lever extends and retracts said locking tabs.

7. The exercise device of claim 6, further comprising the lever of the locking mechanism being positioned on said pedestal.

8. The exercise device of claim 7, further comprising said lever being aligned with said tongue.

9. The exercise device of claim 1, further comprising each of said grips extending perpendicularly to a top surface of said upper body platform, each of said grips being positioned adjacent to a respective one of said arm rests.

10. The exercise device of claim 1, further comprising each of said arm rests being pivotally coupled to a central section of said upper body platforms.

11. The exercise device of claim 1, further comprising each of said arm rests being pivotable such that a distal end of said arm rest relative to said central section is movable vertically.

12. The exercise device of claim 1, further comprising each of said arm rests being pivotable such that said distal end of said arm rest is adjustable forwardly and rearwardly.

13. The exercise device of claim 1, further comprising said wheels being caster wheels wherein said base is configured to roll in any direction on the support surface.

14. The exercise device of claim 1, further comprising:

said upper surface of said base being resiliently compressible;

said peripheral edge of said base being circular; and a lip extending around a lower portion of said upper surface, said lip defining said outer peripheral edge of said base.

15. The exercise device of claim 1, further comprising a pair of channels in said upper surface of said base.

16. The exercise device of claim 15, further comprising:

each of said channels being kidney shaped; and said channels being symmetrical about a diameter of said base extending through a center of said groove.

17. The exercise device of claim 1, further comprising said upper body platform being angled such that said upper body platform extends downward and rearwardly from a forward edge of the upper body platform.

18. An exercise device comprising:

a base, said base having an upper surface, said upper surface being hemispherical wherein said base is configured to require a person kneeling on said base to flex core muscles to maintain balance on said base, said upper surface of said base being resiliently compressible, a peripheral edge of said base being circular;

a lip extending around a lower portion of said upper surface, said lip defining said peripheral edge of said base;

a plurality of wheels coupled to and extending from a bottom of said base wherein said base is configured to roll on a support surface, said wheels being caster wheels wherein said base is configured to roll in any direction on the support surface;

a stand, said stand including a pedestal, said pedestal having concave edge defining a receiver complementary to said base wherein said base is positionable abutting said pedestal within said receiver, an upper body platform including a pair of arm rests and a pair of grips, each of said grips extending perpendicularly to a top surface of said upper body platform, each of said grips being positioned adjacent to a respective one of said arm rests, each of said arm rests being pivotally coupled to a central section of said upper body platforms, each of said arm rests being pivotable such that a distal end of said arm rest relative to said central section is movable vertically, each of said arm rests being pivotable such that said distal end of said arm rest is adjustable forwardly and rearwardly, said upper body platform being angled such that said upper body platform extends downward and rearwardly from a forward edge of the upper body platform, and a support coupled to and extending between said upper body platform and said pedestal, said support being telescopic wherein a distance between said upper body platform and said pedestal is adjustable, said support comprising a pair of telescopic posts;

a locking mechanism, said locking mechanism securing said base to said pedestal such that said base is in a static position relative to said stand when said locking mechanism is engaged;

a tongue coupled to said pedestal, said tongue extending from said concave edge wherein said tongue protrudes into said receiver;

a groove extending into said peripheral edge of said base, said groove being complementary in shape to said tongue, said locking mechanism extending between said tongue and said groove for securing said pedestal and said base together when said locking mechanism is engaged;

said locking mechanism including a pair of recesses extending into said base, said recesses being positioned in and extending into said base from within said groove, a pair of locking tabs, each of said locking tabs being extendable from said tongue, each of said locking tabs extending into a respective one of said recesses whereby said locking tabs inhibit movement of said base away from said pedestal, a lever, each of said locking tabs being mechanically coupled to said lever such that movement of said lever extends and retracts said locking tabs, the lever of the locking mechanism being positioned on said pedestal, said lever being aligned with said tongue; and a pair of channels in said upper surface of said base, each of said channels being kidney shaped, said channels being symmetrical about a diameter of said base extending through a center of said groove.

* * * * *